US005989112A

United States Patent [19]

Long et al.

[11] Patent Number: 5,989,112

[45] Date of Patent: Nov. 23, 1999

[54] UNIVERSAL ABRASIVE DISC

[75] Inventors: David J. Long, Shrewsbury, Mass.; Paul A. Krupa, Grand Island; Richard J. Goupil, North Tonawanda, both of N.Y.

[73] Assignee: Norton Company, Worcester, Mass.

[21] Appl. No.: 09/075,648

[22] Filed: May 11, 1998

[51] Int. Cl.[6] ..... B24D 11/00

[52] U.S. Cl. ..... 451/527; 451/456

[58] Field of Search ..... 451/456, 458, 451/494, 539, 527

[56] References Cited

U.S. PATENT DOCUMENTS

| | | | |
|---|---|---|---|
| 3,788,011 | 1/1974 | Hutchins | 51/170 R |
| 3,827,194 | 8/1974 | Hutchins | 51/170 MT |
| 4,202,140 | 5/1980 | Alessio | 51/395 |

*Primary Examiner*—David A. Scherbel
*Assistant Examiner*—Dung Van Nguyen
*Attorney, Agent, or Firm*—David Bennett

[57] ABSTRACT

Abrasive discs for use with orbital sanders having dust extractor systems are provided in which the discs are adapted for use with orbital sanders having different patterns and numbers of dust extractor holes.

5 Claims, 2 Drawing Sheets

UNIVERSAL ABRASIVE DISC

BACKGROUND OF THE INVENTION

Figure 1:
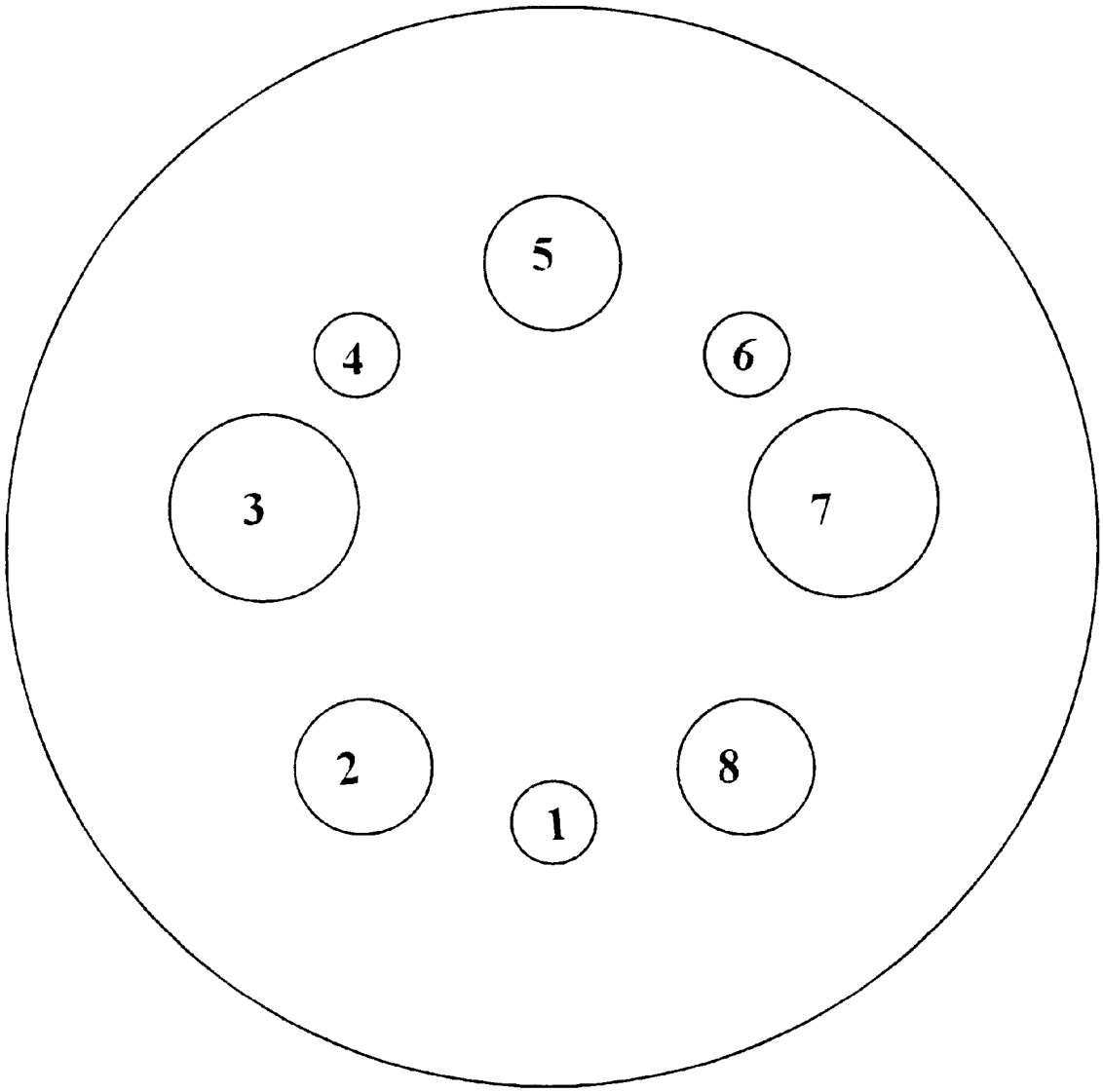

This invention relates to abrasive discs for use with orbital sanders which are designed for use with integral vacuum exhaust systems. Orbital sanders generate a great deal of dust, particularly when used on wood. This dust is not only inconvenient and possibly injurious to health, but it also obscures the view of the surface being sanded and can "blind" the abrasive disc being used. Many manufacturers therefore sell orbital sanders with integral or readily attachable vacuum exhaust systems design to suck away the dust as it is formed. This is done by applying a vacuum to the back of the support pad to which the abrasive disc is attached and providing holes through the support pad and the disc through which the dust can be evacuated as it is generated.

However there is a problem in that the pattern of exhaust holes in the backup pads is not standardized such that abrasive discs intended for use with, for example a Black & Decker Corporation orbital sander, will not fit a sander sold by Porter-Cable Corporation. One type has five exhaust holes whereas the other has eight exhaust holes. This means that the retailer selling to the "Do It Yourself" (or DIY) market must keep at least two different stocks of abrasive discs, in all grit sizes, if he is to be able to service the needs of all his customers. This consumes valuable shelf space which becomes very inconvenient as the number of DIY products for which replacement abrasive materials must be stocked increases.

The purpose of this invention is to provide a "one size fits all" solution to the problem.

DESCRIPTION OF THE INVENTION

The invention provides an abrasive disc provided with eight exhaust holes located in a circle at a point intermediate between the circumference of the disc and its center to coincide with exhaust holes in an eight-holed backup pad for an orbital sander, wherein five of the holes are enlarged to the extent necessary to allow said enlarged holes to coincide also with exhaust holes in a five hole backup pad. for an orbital sander.

The intention of the present invention is that the disc be able to function effectively with a sander fitted with either a five or eight hole backup pad. For effective functioning it is not strictly necessary that there be a 100% overlap between the disc hole and the hole in the backup pad but there must be sufficient to allow the dust exhaust system to function effectively. All degrees of overlap that accomplish this end are embraced by indicating that the holes in the disc "coincide" with holes in the backup pad with which it is used. In practice 100% overlap is preferred but efficient functioning can be achieved with about 75% overlap though this is clearly less preferred. Intermediate levels may be selected as a compromise between degree of overlap and the amount of disc that needs to be removed to ensure 100% overlap.

If the holes in the eight hole sander pad are numbered sequentially in clockwise direction around the disc, and selecting any one of the eight holes as the arbitrary starting point 1 through 8, enlargement of holes 2, 3, 5, 7 and 8 is required. The extent of enlargement required to give 100% overlap is not uniform for all holes. Hole 5 needs only a slight enlargement to give a longest dimension that is one third larger than the diameter of hole number 1. Holes 2 and 8 require a slightly greater enlargement, being about two thirds greater in their longest dimension than the diameter of hole 1. Holes 3 and 7 are enlarged most of all such their greatest dimension is about twice that of the hole 1 diameter. Generally it is most convenient to enlarge holes 2, 5 and 8 by the same amount which is from about 40 to 60% larger than the diameter of the 1 hole; and enlarge holes 3 and 7 such that their longest dimension is 90 to 120% of the radius of the 1 hole. In preferred practice all eight holes are round.

The enlargement can be accomplished by elongation of the holes such that the minimum amount of disc abrasive surface (and also adhesion-surface on the back of the disc) is removed. Alternatively the hole can remain round but enlarged by the amount necessary to encompass both the hole in an eight hole disc and the nearest adjacent hole of a five hole disc. Often it is preferred that the five holes that must be enlarged, are enlarged to the same extent since this makes matching the holes to the holes in the backup pad easier. It is also desirable that the enlargement remove as little of the disc as possible while ensuring that the holes that are enlarged are enlarged to the same extent. While this may remove more disc than is strictly necessary, the consequent greater ease of orienting the disc correctly that results is often considered more important.

While minimum removal of disc is often important, simplifying manufacturing can sometimes be more important and in such event, it can be more advantageous to provide that all holes are the same size, regardless of whether such enlargement is strictly necessary to provide communication with the corresponding hole in the backup pad of the sander to which it is attached.

Since the centers of the holes in a five hole orbital sander are located on a circle that has a slightly larger diameter than the centers of the holes in an eight hole sander, if hole enlargement by elongation is the selected route, the direction of elongation of the above holes is at an angle to the circumference of the disc. The elongation of the hole 5 is along a radial direction. The directions of elongation of the other elongated holes make acute angles to a tangent to the circumference at the point at which the elongation directions intersect the circumference. Holes 1, 4 and 6 serve only the eight hole sander design and therefore require no elongation.

If hole enlargement with retention of the round hole shape is the selected option, the effect of this different placement will be merely that the centers of the enlarged holes will lie slightly outside the circle upon which the centers of the other three (unenlarged) holes lie. If however all holes are enlarged, this make it possible to place the centers of all holes on the same circle.

As a result of these enlargements the disc can be used with complete satisfaction with either five hole or eight hole orbital sander backup pads.

The discs have first and second major surfaces. The first major surface is provided with an abrasive coating comprising abrasive particles and a binder by which the particles are adhered to the surface. The particles and binders can be selected from any of those known in the art for such applications and the configurations on the surface can be provided in any known way including patterned deposition, (as in structured abrasives), as well as the uniform deposition of the abrasive grit on a substrate bearing an uncured maker coat, followed by a size coat and optionally a supersize coat, which characterizes the more popular DIY product lines.

The second major surface is provided with a means for attaching the disc to the backup pad or an orbital sander. This means can be for example a pressure sensitive adhesive or one part of a hook and loop fastener system. Such a system is understood to include variations on this theme including those in which both surfaces to be adhered are provided with spaced, flexible mushroom or arrowhead shapes wherein the surfaces to be joined are releasably connected by pressing the shapes on one surface into the gaps between the shapes on the cooperating surface. Clearly the greater the surface area of the back of the disc, the more secure the attachment of the disc to the backup pad. This is an incentive to minimize the size of the holes as far as possible while achieving the main objective of the invention.

Alternatively the disc can be secured to the backup pad by any other conventional means including a lock nut cooperating with a thread on a spindle of the orbital grinder bearing the backup pad.

DRAWINGS

Figure 2:
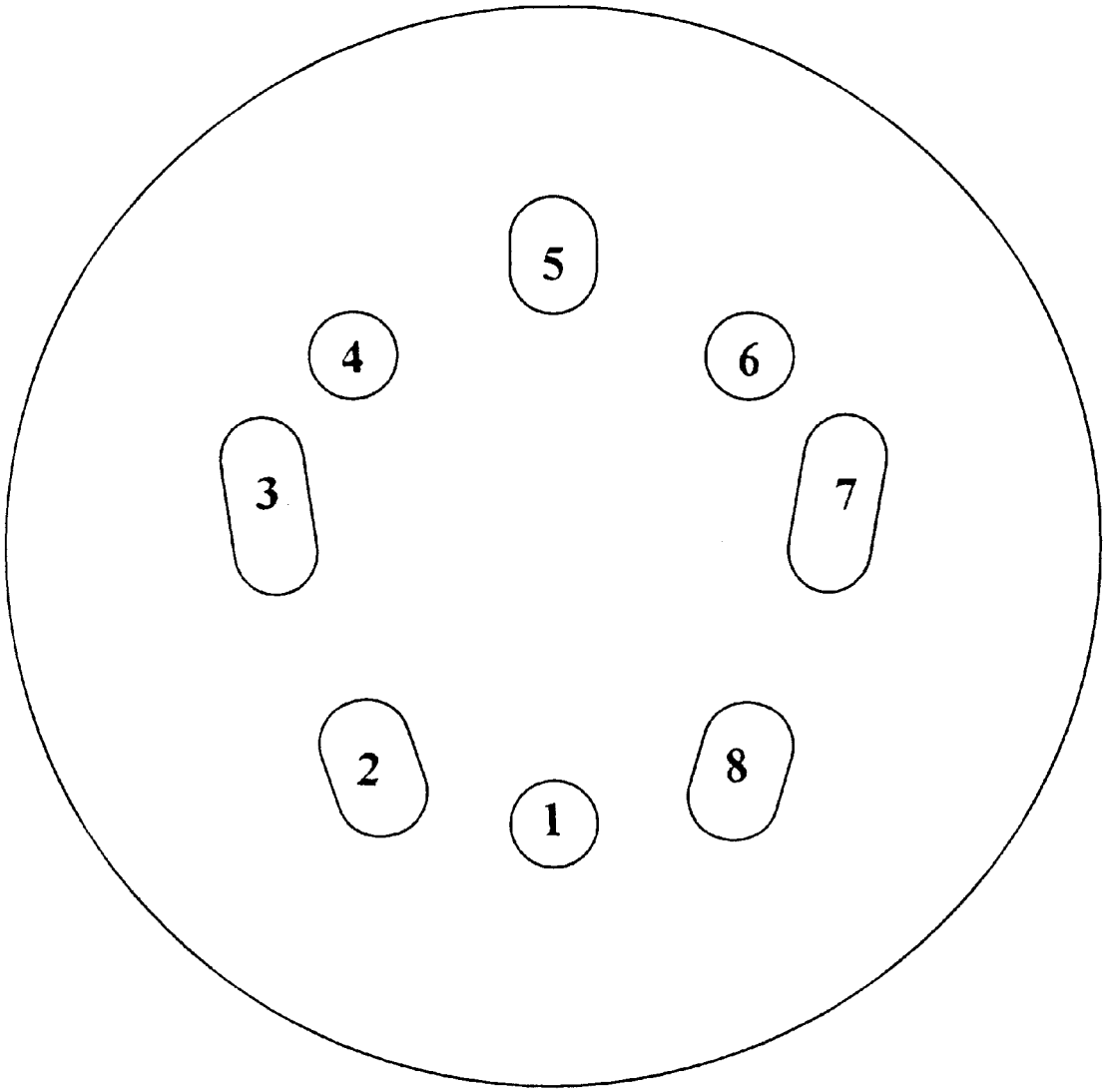

FIGS. 1 and 2 illustrate two forms of disc according to the invention. In each the holes in the disc have been numbered in clockwise sequence around the disc for ease of reference.

FIG. 1 shows the pattern of holes on an abrasive disc according to the invention. This illustrates a preferred form of the invention designed to accomodate 5 inch abrasive discs adapted for use with orbital sanders sold by Porter-Cable, Black & Decker, DeWalt and Makita among others. In this Drawing the holes are enlarged by making five of the holes round but with larger diameters.

FIG. 2 shows a hole pattern where the enlargement is accomplished simply by.elongation of five of the holes.

The same concept can be extended to produce discs adapted to serve the needs of seven inch abrasive discs for larger orbital sanders.

It is within the reasonable scope of this invention to enlarge the basic concept to cover other hole configurations should such be introduced in the market place. The design technique involved requires that the two discs for which a universal disc is to be designed be placed on a flat surface with the disc centers aligned and the disc with the smaller number of holes on top.

One hole is chosen as the measuring hole and is located to coincide, as nearly as possible, with a hole in the disc beneath. The two discs are then fixed in terms of their relative positions and the shape of the holes of the disc with the smaller number of holes is traced on the surface of the disc below. The holes on the disc below that are closest to a hole shapes traced on it are then enlarged to embrace the hole shape and the product is a universal disc that will meet the needs of orbital sanders with backup pads having either hole pattern. In a typical design the size of the enlarged holes is standardized on the size of the largest enlarged hole since this makes fitting of the disc to a backup pad much more simple. These standardized enlarged holes can be round or elongated or any other convenient shape.

This design technique is of course adapted for commercial exploitation by programming an automatic hole punch machine to provide holes of the desired spacing and size as determined using the technique.

This technique can be adapted to fit the needs of a plurality of design hole patterns, provided that the enlargements involved do not collectively weaken the structural integrity of the disc or reduce the amount of grinding surface to an unacceptable extent.

What is claimed is:

1. An abrasive disc for use with an orbital sander fitted with a dust extraction system having five or eight round dust extraction holes, wherein the disc is provided with eight dust extraction holes located such that they can be placed in register with the holes in an eight hole dust extraction system and wherein at least five of said holes are enlarged such the enlarged holes can be placed in register with the holes in a five hole dust extraction system.

2. An abrasive disc according to claim 1 wherein the holes are enlarged by elongation of selected holes such that, if the dust extraction holes are numbered 1 through 8, holes 2, 5 and 8 have a longest dimension that is 40 to 60% larger than the diameter of hole number 1; and the greatest dimension of holes 3 and 7 is from 90 to 120% larger than the hole 1 diameter.

3. An abrasive disc according to claim 1 wherein selected holes are enlarged by elongation such that the longest dimension is about twice the diameter of the unenlarged holes.

4. An abrasive disc according to claim I in which all holes are enlarged and have the same diameter.

5. A method of designing a universal abrasive disc adapted for use with dust extractor sytems having two different patterns or numbers of dust extractor holes which comprises:

(i) placing the two discs for which a universal replacement disc is to be designed on a flat surface with the disc centers aligned and the disc with the smaller number of holes on top;

(ii) selecting one hole as the measuring hole and locating said measuring hole to coincide, as nearly as possible, with a hole in the disc beneath;

(iii) fixing the relative positions of the two discs;

(iv) tracing the shape of the holes of the disc with the smaller number of holes on the surface of the disc below;

(v) removing the upper disc and enlarging the holes on the lower disc such that they encompass also the closest hole shapes traced thereon; and (vi) using the disc with the enlarged holes as a model in the production of a universal abrasive disc.

* * * * *